United States Patent [19]

Zodrow

[11] Patent Number: 4,718,373

[45] Date of Patent: Jan. 12, 1988

[54] ADHESIVE APPLICATOR FOR A LABELING MACHINE

[75] Inventor: Rudolf Zodrow, Dusseldorf, Fed. Rep. of Germany

[73] Assignee: Krones Ag Hermann Kronseder Maschinefabrik, Neutraubling, Fed. Rep. of Germany

[21] Appl. No.: 873,565

[22] Filed: Jun. 12, 1986

[30] Foreign Application Priority Data

Jun. 14, 1985 [DE] Fed. Rep. of Germany ..... 3521394
Mar. 15, 1986 [DE] Fed. Rep. of Germany ..... 3608773

[51] Int. Cl.[4] ..... B05C 1/02

[52] U.S. Cl. ..... 118/262; 118/261; 156/568

[58] Field of Search ..... 156/568, 578; 118/236, 118/259, 262, 261, 231

[56] References Cited

U.S. PATENT DOCUMENTS 4,385,960 5/1983 Zodrow et al. ..... 156/568

FOREIGN PATENT DOCUMENTS 3113980 10/1982 Fed. Rep. of Germany ..... 156/568

*Primary Examiner*—John P. McIntosh
*Attorney, Agent, or Firm*—Sprung Horn Kramer & Woods

[57] ABSTRACT

An adhesive applicator for a labeling machine. It consists of an adhesive roller, especially one with a resilient surface, of an adhesive-supply mechanism, of an adhesive doctor positioned behind the supply mechanism in relation to the direction that the roller rotates in, and of a label getter with an adhesive-pickup surface that is in particular rigid and that rolls over the surface of the adhesive roller. To decrease the risk of damage to the adhesive roller due to defective labels adhering to the adhesive-pickup surface, the surface of the adhesive roller is a friction surface that removes, at least to some extent mechanically, defective labels that get jammed up upstream of the adhesive doctor and/or the adhesiveness of the surface of the adhesive roller is established in relation to the adhesiveness of the adhesive-pickup surface of the label getter to the extent that defective labels on the adhesive-pickup surface will remain on that surface when the label getter rolls over the surface of the adhesive roller.

2 Claims, 1 Drawing Figure

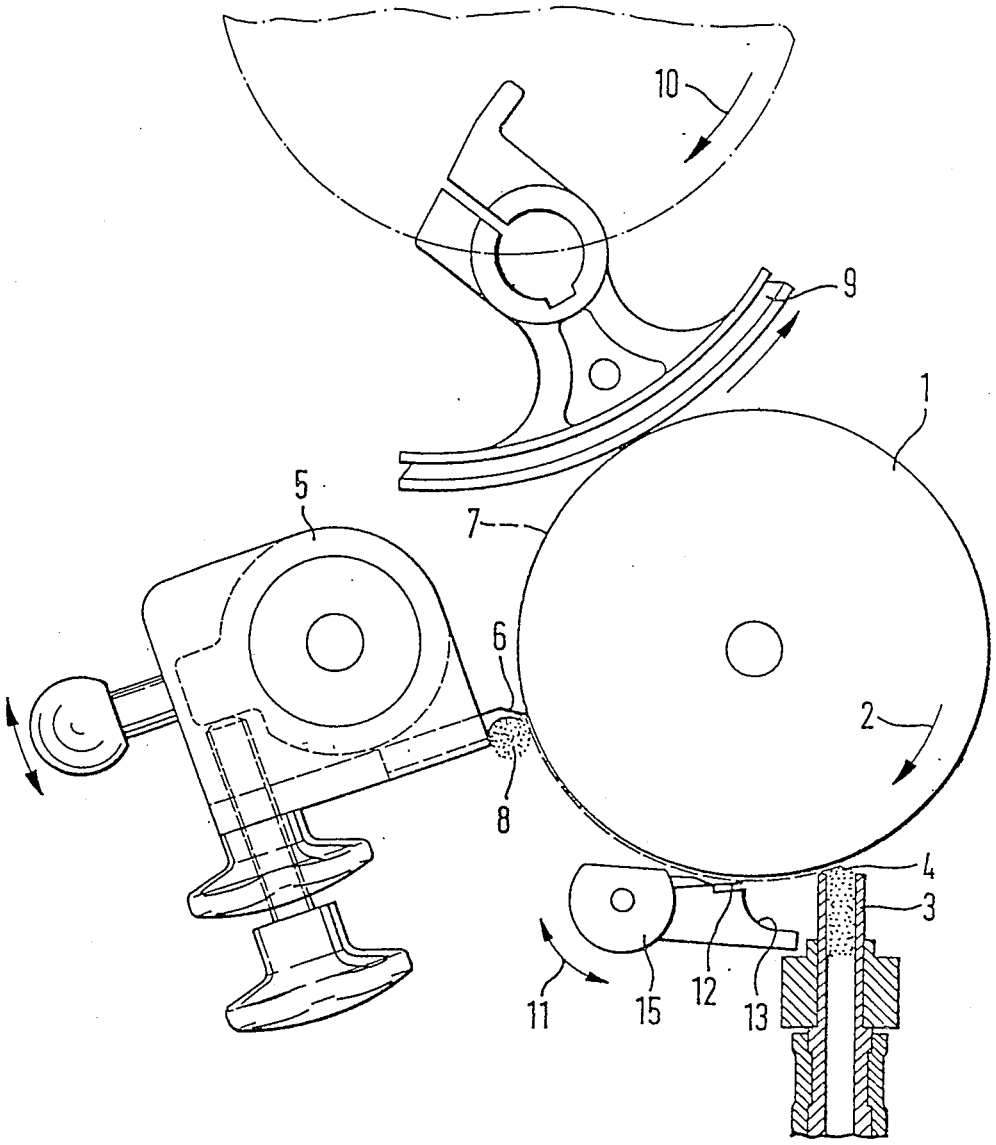
10
9
1
5
7
6
2
8
4
3
11
15
12
13

ADHESIVE APPLICATOR FOR A LABELING MACHINE

BACKGROUND OF THE INVENTION

The invention concerns an adhesive applicator for a labeling machine and consisting of an adhesive roller, especially one with a resilient surface, of an adhesive-supply mechanism, of an adhesive doctor positioned behind the supply mechanism in relation to the direction that the roller rotates in, and of a label getter with an adhesive-pickup surface that is in particular rigid and that rolls over the surface of the adhesive roller.

Adhesive applicators of this type are known (German patent No. 3 113 980). The adhesive roller generally has a resilient surface that rotating or rocking metal adhesive pallets roll over to pick up adhesive to apply to the labels. The applicators can be equipped with either a single adhesive doctor that ensures a uniform layer of adhesive over the total height of the adhesive roller or with two adhesive doctors. If there are two adhesive doctors, the one that is upstream in relation to the direction of rotation is designed as a preliminary doctor and the downstream doctor as a flow-metering doctor. The latter design allows layers of different thicknesses to be applied over the total height of the adhesive roller with a single segmented doctor. Adhesive layers of different thicknesses are desirable when different types of label, foil and paper for instance, are to be applied to an article.

All of these adhesive applicators are subject to malfunction as the result of labels being accidentally applied to the adhesive roller by the transfer mechanisms, the adhesive pallets for example. The labels, specifically, get jammed up upstream of the adhesive doctor, not only making it impossible to establish the desired thickness of the layer of adhesive but also causing the adhesive roller to heat up due to friction and hence to wear prematurely. Attempts have been made in many ways to eliminate these causes of malfunction.

The adhesive roller in one known applicator has continuous grooves around it with belts extending through them. The belts travel over a deflection mechanism positioned parallel to and at a distance from the adhesive roller. A comb engages between the free-running belts in the space between the adhesive roller and the deflection mechanism, and lifts off the defective labels transferred to the adhesive roller and advanced by the belts. This type of adhesive applicator is relatively expensive.

The adhesive roller in one known embodiment has a steel surface. The surfaces of the transfer mechanisms, the adhesive pallets for instance, are covered with a resilient material. It is difficult to fabricate a surfacing of this type that is precise enough to ensure non-slip roll-over, especially because pallets have to have recesses for the gripper mechanisms. Narrow webs are left in the vicinity of these recess, and it is difficult to fasten them permanently to their metal supports.

SUMMARY OF THE INVENTION

The object of the present invention is to create an adhesive applicator of the aforesaid type with a decreased risk of damage to the adhesive roller due to defective labels adhering to the adhesive-pickup surface because subsequent processing mechanisms fail to remove them.

This object is attained in accordance with the invention in an adhesive applicator of the aforesaid type in that the surface of the adhesive roller is a friction surface that removes, at least to some extent mechanically, defective labels that get jammed up upstream of the adhesive doctor. The friction surface can preferably be created by embedding abrasive structures in the resilient surface of the adhesive roller.

The object can, however, also be attained by a completely different means although preferably in conjunction with the foregoing means, by establishing the adhesiveness of the surface of the adhesive roller in relation to the adhesiveness of the adhesive-pickup surface of the label getter to the extent that defective labels on the adhesive-pickup surface will remain on that surface when the label getter rolls over the surface of the adhesive roller. The difference in adhesiveness can preferably be obtained by roughening the surface of the adhesive roller.

The invention proceeds in a very different direction than that at the state of the art. The invention makes it possible to retain the well-proven combination of resilient adhesive-roller surface and rigid, especially metallic, label getter (adhesive pallet). The risk to the adhesive roller due to defective labels jamming up upstream of the adhesive doctor, specifically, is decreased as a result of the surface of the adhesive roller being designed as a friction surface that mechanically removes jammed-up labels. Experience has demonstrated that labels can only exceptionally be mechanically removed from upstream of the adhesive doctor when they get caught in the wedge-shaped nip between the adhesive roller and the adhesive doctor. As a rule, however, only the leading edge of a label gets caught between the doctor and the roller, whereas the rest of the label becomes subject to a rotating bolster of adhesive that forms upstream of the doctor. In this case, the label tears as the result of mechanical forces and the part that remains in the bolster is removed along with the adhesive. In either case, the friction surface will ensure that labels jammed up in the nip between the adhesive roller will not permanently diminish the flow of adhesive or interrupt its application. Although this malfunction is admittedly of subsidiary significance, preventing the brief mechanical forces and the removal of the remaining section of the label from the vicinity of the doctor by the bolster of adhesive from leading to excessive wear on the adhesive roller is decisive.

The risk to the adhesive roller due to defective labels getting jammed up upstream of the adhesive doctor is eliminated in the second approach to the object of the invention by the special relation between the adhesiveness of the surface of the adhesive roller and that of the label getter with the result that individual defective labels are not as a rule transferred to the adhesive roller. If any are, the adhesive roller will, if its surface is still a friction surface, act as in the first approach. Thus, when the two approaches are combined, the protection will be double. Experience has demonstrated that the transfer of defective labels from the adhesive-pickup surface of the label getter to the surface of the adhesive roller can be prevented by the same measures that mechanically remove labels jammed up upstream of the adhesive doctor, by the friction surface, that is, specifically the abrasive structures embedded in the resilient surface of the adhesive roller. This preferred embodiment of the friction surface has another advantage in that the abrasive structures will only come into action subject to the pressure that derives from jammed-up labels. The structures can in fact be embedded in such a way that only the resilient material in the surface of the adhesive roller will yield subject to pressure, and the abrasive structures will project out of the surface. As long as no labels are jammed up, accordingly, only the resilient material in the surface of the roller will act, in conjunction with the rigid surface of the label-transfer mechanism.

The difference between the adhesiveness of the surface of the adhesive roller and that of the adhesive-pickup surface of the label getter will as a rule prevent individual labels from being transferred to the adhesive roller. As the labels continue to be obtained and transferred to the subsequent processing mechanisms, the defective label adhering to the adhesive-pickup surface will not have a negative effect. Adhesive can be applied to the surface, along with the defective label adhering thereto, and labels can still be obtained by that surface with its adhesive. The slighter adhesive pickup at the adhesive roller due to the label adhering to it will be negligible. Malfunctions can occur only when several defective labels have stacked up on the adhesive-pickup surface. If, then, the labels get transferred to the adhesive roller, they will be removed as previously described herein, either mechanically or by entrainment with the bolster of adhesive.

The decreased adhesiveness of the surface of the adhesive roller also promotes removal of defective labels that have been transferred to the adhesive roller to the extent that the inherent stiffness of the labels are easier to remove from the surface of the adhesive roller by their leading edge. This decreases the risk of the leading edges of the labels getting between the doctor and the roller or getting jammed up and removed there. If the leading edge of a defective label lifts off of the surface of the adhesive roller, it will arrive in the rotating bolster of adhesive and will almost always drop out, leaving no necessity of removing the label mechanically.

The measures in accordance with the invention that involve an adhesive roller with a friction surface can be employed not only with an adhesive applicator with only one adhesive roller, but also with one that has two adhesive rollers, one downstream and the other upstream, that roll off each other. If two adhesive rollers are employed, the one that rolls off the label getter will be conventional in design, with, that is, only a resilient surface, whereas the other roller will have the friction surface. The roller with the friction surface in this embodiment can also have a rigid surface, a steel surface for instance. Measures must be provided in such an embodiment, however, to ensure transfer of the labels obtained by the roller with the resilient surface to the roller with the friction surface. Transfer can be ensured either by means of guides resting against the roller with the resilient surface, in the intake-end nip between the two rollers, or by selecting appropriate materials for both adhesive rollers (with different adhesion to the label).

BRIEF DESCRIPTION OF THE DRAWING

The invention will now be specified with reference to the drawing wherein the FIGURE is a schematic representation of the application according to the invention.

DETAILED DESCRIPTION OF THE INVENTION

An adhesive applicator has an adhesive roller 1 in the form of a circular cylinder that can be rotated in the direction indicated by arrow 2. An adhesive-supply mechanism 3 in the form of a pipe that terminates at the upper edge of adhesive roller 1 applies adhesive 4 to the surface of the roller. Adhesive 4 flows down along adhesive roller 1 and builds up at the blade 6 of a pivoting adhesive doctor 5. When adhesive roller 1 rotates, a rotating column or "bolster" 8 of adhesive builds up in the hollow of adhesive-doctor blade 6. The variable distance between blade 6 and the surface of adhesive roller 1 determines the thickness of the film 7 of adhesive allowed through.

A rigid metal label getter 9 with a convex adhesive-pickup surface rolls over the surface of adhesive roller 1. Label getter 9 rotates or pivots around its own axis and is positioned on a mount that rotates in the direction indicated by arrow 10.

Another adhesive doctor 15, which can be pivoted in the direction indicated by double-headed arrow 11, is positioned between adhesive-doctor blade 6 and supply mechanism 3. Adhesive doctor 15 has a blade 12 with a hollow 13, and functions, due to its position as illustrated in the FIGURE, as a preliminary doctor, leaving a film of adhesive about 2 mm thick. When, however, doctor 15 is pivoted against adhesive roller 1, it blocks the passage of the adhesive. In the position illustrated in the FIGURE, adhesive-doctor blade 6 determines the strength of the adhesive that is allowed through to label getter 9.

Adhesive roller 1 is made out of two different materials, meaning that abrasive structures are embedded in its surface. The adhesive-pickup surface of the metal label getter 9 is smooth. The adhesiveness of the adhesive-pickup surface is related to that of the surface of adhesive roller 1 in such a way that a label that adheres with adhesive to the adhesive-pickup surface of label getter (adhesive pallet) 9 is not likely to be picked up by the adhesive roller as the label getter rolls over it. Even if, however, one defective label is picked up, its inherent stiffness will, in conjunction with the low adhesiveness of the surface of the adhesive roller, tend to cause at least its leading edge to separate from the surface. Thus, at least the leading edge of the label will not arrive in the nip between adhesive doctor 15 and adhesive roller 1, but will wind up in the bolster of adhesive upstream of hollow 13. Finally, if, in spite of all these measures, a label does arrive in the nip between adhesive roller 1 and doctor blade 12, it will be removed mechanically due to the friction surface. Even if one section of the label gets through, the label will tear and the section remaining upstream of the hollow will be removed by the bolster.

The measures in accordance with the invention will at any rate prevent damage to or malfunctions in the surface of the adhesive roller. Although such malfunctions can indeed be prevented by either of these measures alone, by, that is, the difference between the adhesiveness of the adhesive roller and that of the adhesive-pickup surface or by the friction in the surface of the adhesive roller, it is preferable to employ both measures together to enhance the protection against malfunctions.

I claim:

1. In an adhesive applicator for a labeling machine, having an adhesive roller rotatable in one direction and with a resilient surface, adhesive-supply means for applying adhesive to the roller, an adhesive doctor position downstream of the adhesive-supply means in relation to the one direction that the roller rotates in, and a label pickup element with a rigid adhesive-pickup surface and mounted to roll the adhesive-pickup surface over the surface of the adhesive roller downstream of the doctor, the improvement wherein the surface of the adhesive roller is a friction surface comprising abrasive structures embedded in the resilient surface of the adhesive roller and that removes, at least to some extent mechanically, defective labels that get jammed up upstream of the adhesive doctor.

2. In an adhesive applicator for labeling machine, having an adhesive roller rotatable in one direction and with a resilient surface, adhesive-supply means for applying adhesive to the roller, an adhesive doctor positioned downstream of the adhesive supply means in relation to the one direction that the roller rotates in, and a label pickup element with a rigid adhesive-pickup surface and mounted to roll the adhesive pickup surface over the surface of the adhesive roller downstream of the doctor, the improvement wherein the adhesiveness of the surface of the adhesive roller is established in relation to the adhesiveness of the adhesive-pickup surface of the pickup element to the extent that defective labels on the adhesive-pickup surface will remain on that surface when the pickup element surface rolls over the surface of the adhesive roller and wherein the surface of the adhesive roller is roughened.

* * * * *